US006502314B1

(12) United States Patent
McCatty

(10) Patent No.: US 6,502,314 B1
(45) **Date of Patent: *Jan. 7, 2003**

(54) KNIFE HANDLE

(76) Inventor: Michael S. McCatty, 14518 Innisbrook, Lockport, IL (US) 60441

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/317,279

(22) Filed: May 24, 1999

(51) Int. Cl.[7] ..... B25G 1/00; B25G 3/00
(52) U.S. Cl. ..... 30/340; 30/342; 16/430
(58) Field of Search ..... 30/340, 342, 296.1, 30/298; 81/489, 177.1; 16/430

(56) References Cited

U.S. PATENT DOCUMENTS

| | | | | | |
|---|---|---|---|---|---|
| D57,935 | S | * | 5/1921 | Shively | D8/99 |
| 1,750,577 | A | * | 3/1930 | DeBracht | 30/298 |
| 2,073,618 | A | * | 3/1937 | Askue | 30/298 |
| 2,153,759 | A | * | 4/1939 | Katzinger | 30/298 |
| 2,352,013 | A | * | 6/1944 | Roth | 30/298 |
| 2,421,339 | A | | 5/1947 | Leger | 30/165 |
| 3,231,930 | A | * | 2/1966 | Berry | 30/298 |
| 3,592,247 | A | * | 7/1971 | Solf | 81/177.1 |
| D236,579 | S | | 9/1975 | Morhack | D7/152 |
| 4,178,684 | A | * | 12/1979 | Mightly | 30/344 |
| 4,283,854 | A | * | 8/1981 | Austin | 30/340 |
| 4,380,122 | A | * | 4/1983 | Jagger | 30/295 |
| D279,254 | S | | 6/1985 | Smith et al. | D8/107 |
| D280,173 | S | | 8/1985 | Welch | D7/152 |
| D300,601 | S | * | 4/1989 | Himbert et al. | D8/107 |
| 4,934,024 | A | * | 6/1990 | Sexton, I | 81/489 |
| D317,847 | S | | 7/1991 | Loveless | D7/649 |
| D318,602 | S | | 7/1991 | Vosbikian | D8/10 |
| 5,075,975 | A | * | 12/1991 | Wilson | 30/322 |
| D323,448 | S | | 1/1992 | Salviato | D7/649 |

(List continued on next page.)

FOREIGN PATENT DOCUMENTS

| | | | | |
|---|---|---|---|---|
| EP | 0090256 A1 | * | 3/1983 | |
| GB | 2058648 A | * | 4/1981 | B25G/1/10 |
| GB | 2271738 A | * | 4/1994 | B26B/3/08 |

*Primary Examiner*—M. Rachuba
(74) *Attorney, Agent, or Firm*—Olson & Hierl, Ltd.

(57) ABSTRACT

A knife handle suitable for use in connection with a blade with proximal and distal side and top faces. The knife handle includes an elongate hand gripping member and a unitary proximal digital member. The digital member has side faces which overlie the proximal side faces of the blade and an arm which overlies the proximal top face of the blade. A thumb groove and a first finger groove are formed in the side faces respectively of the proximal digital member and an index finger groove is formed in the arm of the digital member. The knife handle can be gripped in several ways including a grip where the index finger is extended fully over the arm of the digital member and the thumb and forefinger are positioned in the thumb and first finger grooves respectively.

2 Claims, 3 Drawing Sheets

U.S. PATENT DOCUMENTS

| | | | | | |
|---|---|---|---|---|---|
| D329,185 | S | | 9/1992 | Hasegawa | D8/107 |
| D337,022 | S | | 7/1993 | Sheets | D7/401.2 |
| 5,251,380 | A | * | 10/1993 | Craig | 30/340 |
| D350,835 | S | | 9/1994 | Wang | D28/34 |
| 5,365,666 | A | * | 11/1994 | Gonzalez | 30/340 |
| D354,881 | S | | 1/1995 | Huff | D7/401.2 |
| D355,831 | S | | 2/1995 | Hull et al. | D8/107 |
| D356,021 | S | | 3/1995 | Hull et al. | D8/107 |
| D358,529 | S | | 5/1995 | Rich | D7/401.2 |
| 5,475,894 | A | * | 12/1995 | Wildforster | 81/489 |
| D365,725 | S | | 1/1996 | Hasegawa | D7/401.2 |
| 5,528,834 | A | * | 6/1996 | Seber et al. | 30/340 |
| D372,635 | S | | 8/1996 | Gebhardt | D7/401.2 |
| D373,289 | S | | 9/1996 | Gebhardt | D7/401.2 |
| 5,556,092 | A | * | 9/1996 | Theken | 81/177.1 |
| D378,798 | S | | 4/1997 | Berti | D8/107 |
| D383,049 | S | | 9/1997 | Concari et al. | D8/107 |
| D392,539 | S | * | 3/1998 | Balolia | D8/99 |
| 5,724,739 | A | * | 3/1998 | Hutton | 30/340 |
| 5,769,094 | A | * | 6/1998 | Jenkins, Jr. et al. | 30/161 |
| D400,632 | S | * | 11/1998 | Powell | D22/101 |
| D414,989 | S | * | 10/1999 | Shamoon | D7/649 |
| 5,975,909 | A | * | 11/1999 | Ritchie | 30/322 |
| 6,009,600 | A | * | 1/2000 | Egeland et al. | 81/489 |
| 6,105,262 | A | * | 8/2000 | Rickard | 30/349 |

* cited by examiner

KNIFE HANDLE

FIELD OF THE INVENTION

This invention relates to a knife and, more particularly, to a handle for a knife.

BACKGROUND OF THE INVENTION

In certain applications, chefs and other users of the types of knives contemplated by this invention often place their thumb and index finger directly on the proximal portion of the blade of the knife rather than on the handle itself. The use of a knife in this manner, however, necessarily increases the risk of injury and the formation of callouses as a result of a user's digits being placed directly in contact with the blade. Additionally, the use of a knife in this manner is uncomfortable for the user particularly where the index finger is placed and seated in abutting relationship with the top of the blade.

The present invention solves these problems by providing a knife handle including a proximal digital portion which extends over the blade and allows a user to extend and place his fingers over the proximal digital portion of the handle instead of directly on the blade thus eliminating the risk of injury and finger discomfort.

Current knife handles are also designed for ambidextrous use rather than being non-ambidextrously designed for either right or left handed use as is preferred by those who regularly use knives such as chefs. The present invention also provides a handle which is custom fitted and designed for either a right or left handed user, but not both.

SUMMARY OF THE INVENTION

The knife handle of the present invention is suitable for use in connection with a knife including a blade with proximal and distal side and top faces. The handle includes an elongate hand gripping member and a unitary proximal digital member. The digital member includes side faces which overly the proximal side faces of the blade. The proximal digital member also includes an arm which overlies the proximal top face of the blade and is adapted to receive the extended index finger of a user. In this manner, the index finger need not be placed directly on the top of the blade and the risk of injury and finger discomfort is eliminated.

The arm includes a groove which receives the index finger of the user. A thumb groove is formed in one of the side faces of the proximal digital member and a first finger groove is formed in the other of the side faces of the proximal digital member. The thumb groove and the first finger groove are disposed generally opposite each other and the index finger groove is disposed on the arm therebetween and fore of the thumb and first finger grooves. The thumb groove extends generally along the longitudinal axis of the handle while the first finger groove extends generally perpendicular to the longitudinal axis of the handle. A shoulder is formed on the arm of the proximal digital member and bridges the proximal digital member and the gripping member. The thumb of the user is seatable against the shoulder.

The knife handle of the present invention can advantageously be gripped in several different manners including, but not limited to, a grip where the index finger is fully extended over the arm and positioned in the groove on the arm while the thumb and forefinger are positioned in the thumb groove and the first finger groove respectively of the digital member. The remaining fingers are wrapped around the body of the handle gripping member.

Other features and advantages of the present invention will become readily apparent from the following description, the appended drawings, and the accompanying claims.

DESCRIPTION OF THE PREFERRED EMBODIMENT

Figure 1:
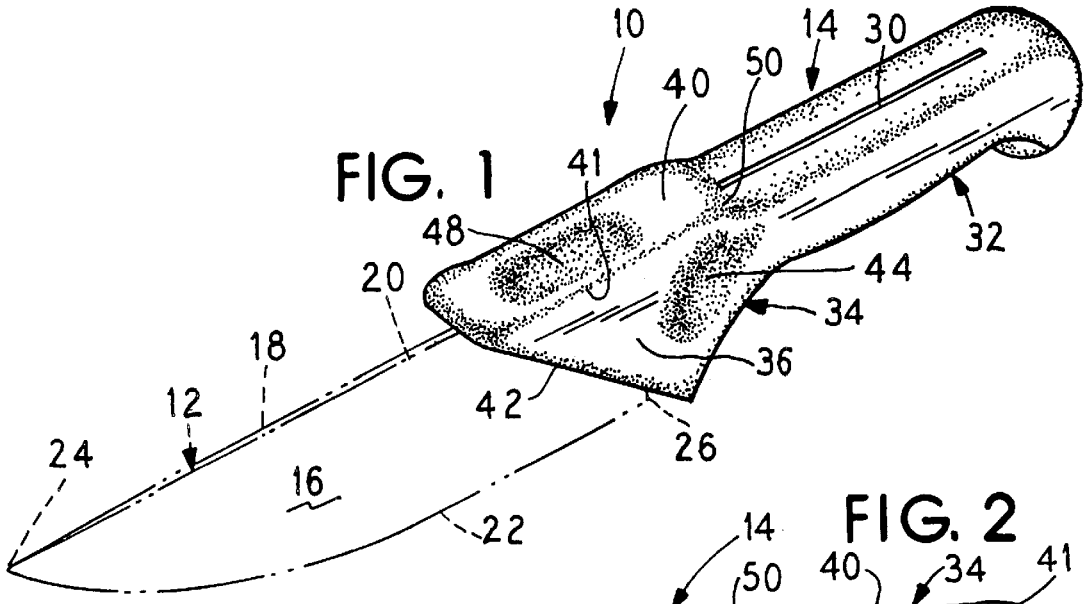
FIG. 1 is a perspective view of a knife incorporating a handle constructed in accordance with the invention, the knife blade being shown in phantom.

The invention disclosed herein is, of course, susceptible of embodiment in many different forms. Shown in the drawings and described hereinbelow in detail is a preferred embodiment of the knife handle of the present invention. It is understood, however, that the present disclosure is an exemplification of the principles of the invention and does not limit the invention to the illustrated embodiment.

For ease of description, a knife handle embodying the present invention is described as shown in the accompanying drawings where the knife is positioned in its customary cutting and slicing orientation and terms such as upper, lower, horizontal, vertical, etc., will be used herein with reference to this position and orientation.

Figure 2:
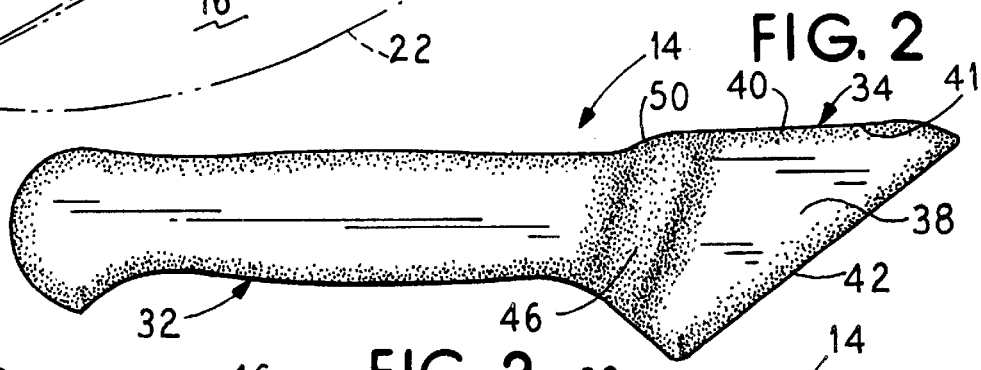
FIG. 2 is a right side elevational view of the knife handle of FIG. 1.
Figure 3:
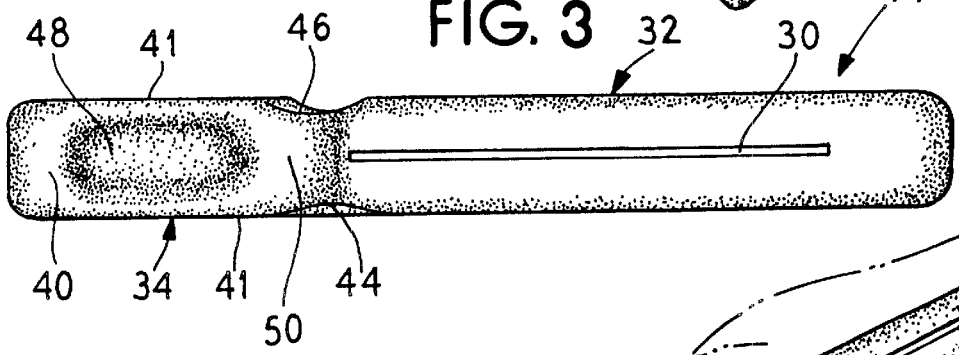
FIG. 3 is a top plan view of the knife handle of FIG. 1.

Referring now to the drawings, and more particularly to FIGS. 1–3, there is shown therein a knife 10 including a elongate blade 12 and a handle 14 constructed in accordance with the present invention.

The blade 12, which can be of any desired shape or form, is made of stainless steel or the like material and includes opposed side vertical faces 16 and 18, a top longitudinally extending and generally flat horizontal face 20 and an arcuate lower cutting face 22. The blade 12 includes a distal pointed tip 24 and a proximal butt end or edge 26 which extends into the handle 14. A elongate blade arm member 30 unitary with the butt end 26 extends through the interior of the handle 14 to secure the blade 12 to the handle 14.

The handle 14, which may be made of any suitable material such as wood, molded plastic or the like material, includes an elongate hand gripping member 32 and a proximal digital member 34 which extends unitarily forwardly from the gripping member 32.

The proximal digital member 34 includes opposed generally vertically oriented side faces 36 and 38 which overly proximal portions of the side faces 16 and 18 of the blade 12 respectively and a unitary generally horizontally oriented top elongate arm or face 40 which overlies a proximal portion of the top face 20 of the blade 12. The arm 40 is unitary with and is joined to the side faces 36 and 38 at their respective top longitudinal edges 41. In accordance with the present invention, and as shown in, for example, FIGS. 2–4 which depict a scaled version of the handle 14 of the present invention, the arm 40 preferably has a length greater than about one fourth the length of the handle 14.

In the embodiment shown, each of the side faces 36 and 38 is generally in the shape of a right triangle in which an elongate edge 42 of the faces 36 and 38 respectively defines the hypotenuse side of the triangle and the elongate top edges 41 of the side faces 36 and 38 respectively defines the leg side of the triangle. The edge 42 extends angularly upwardly, from a bottom edge of the proximal digital member 34, in the direction of the top face 20 of the blade 12 and terminates in the top edge 41 and the arm 40. In the embodiment shown, the edge 42 is disposed at approximately a forty-five degree (45°) angle relative to the longitudinal axis of the blade 12 and the handle 14.

The side face 26 includes a generally oval shaped groove or recess 44 which is shaped to receive the thumb of a user as described below in more detail. The opposed side face 38 includes a groove or recess 46 which is positioned in a generally opposed relationship to the groove 44 and is shaped to receive either the extended forefinger or index finger of a user as will also be described below in more detail. In the embodiment shown, the groove 44 is disposed generally co-linearly with the longitudinal axis of the handle 14 and the butt end or edge 26 of the blade 12 and is located between and spaced from the edges 41 and 42 of the side face 36. Further, in the embodiment shown, the groove 46 is disposed generally perpendicularly to the longitudinal axis of the handle 14 and co-linearly with the butt end or edge 26 of the blade 12 and extends between and through the top and bottom edges 40 and 42 of the proximal digital member 34.

The arm 40 includes an elongate groove or recess 48 which is shaped to receive the index finger of a user as will also be described below in more detail. In the embodiment of FIGS. 1–3, the groove 48 is positioned on the arm 40 between and fore of the grooves 44 and 46 with the forward edge of the thumb and finger grooves 44 and 46 respectively being generally vertically co-linearly aligned with the rear edge of the groove 48.

A shoulder 50, which is formed on the arm 40, extends between the digital member 34 and the gripping member 32. The shoulder 50 is positioned generally directly above the grooves 44 and 46 and the thumb of a user is adapted to be rested or seated against the shoulder 50 in a manner as will also be described below in more detail.

FIGS. 4–9 depict several of the ways in which the handle 14 of the present invention may be gripped by the hand of a user.

Figure 4:
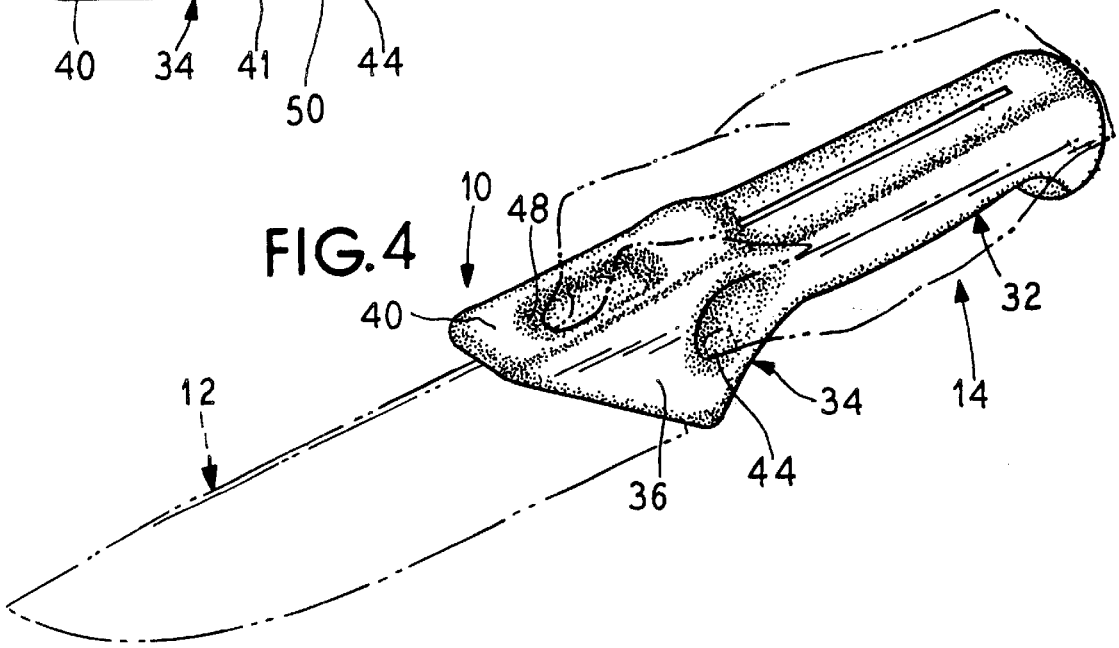
FIG. 4 is a left side perspective view similar to FIG. 1 depicting in phantom one of the hand grips for the handle of the present invention, the knife blade being shown therein in phantom.
Figure 5:
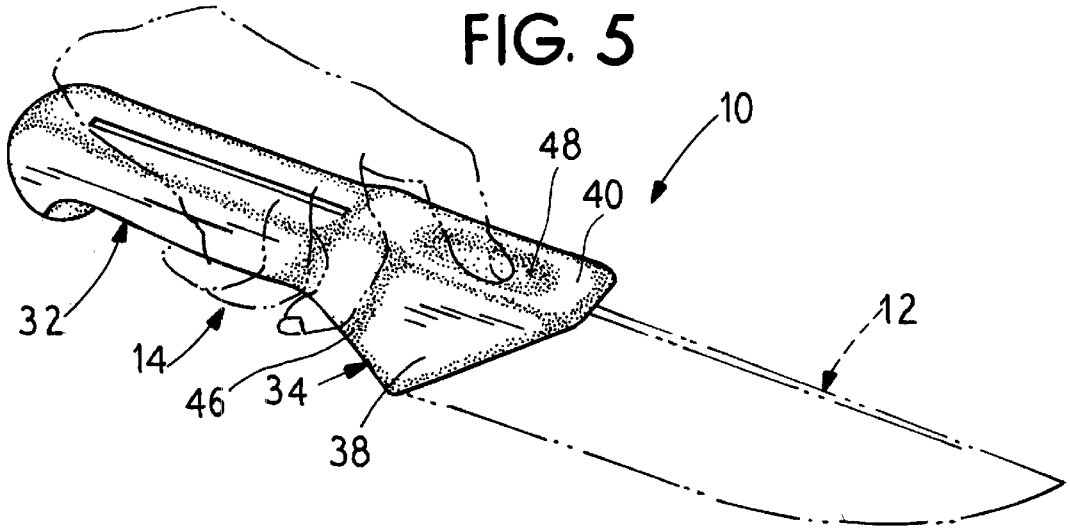
FIG. 5 is a right side perspective view of the hand grip of FIG. 4, the knife blade being shown therein in phantom.

FIGS. 4 and 5 depict one of the grips of the handle 14 where a user's hand is positioned on the handle 14 in an orientation where the bent index finger of a user overlies the arm 40 of the digital member 34 and the tip of the finger is seated in the groove 48. The thumb of the user is extended and seated in the groove 44 in the side face 36 of the member 34 in a generally co-linear orientation relative to the longitudinal axis of the handle 14. The user's forefinger (FIG. 5) is extended and seated in the groove 46 in the side face 38 in a generally perpendicular orientation relative to the longitudinal axis of the handle 14 with the side face of the extended forefinger in abutting relationship with the surface of the groove 46. The remaining two fingers are wrapped around the body of the gripping member 32.

The grip of FIGS. 4 and 5 is particularly suited for uses of the knife 10 where precise and controlled cuts are made to a food item such as, for example, where a user wishes to create an ornate or decorative garnish having a precise contour or pattern. In these applications, the bent index finger provides the required precise knife control.

Figure 6:
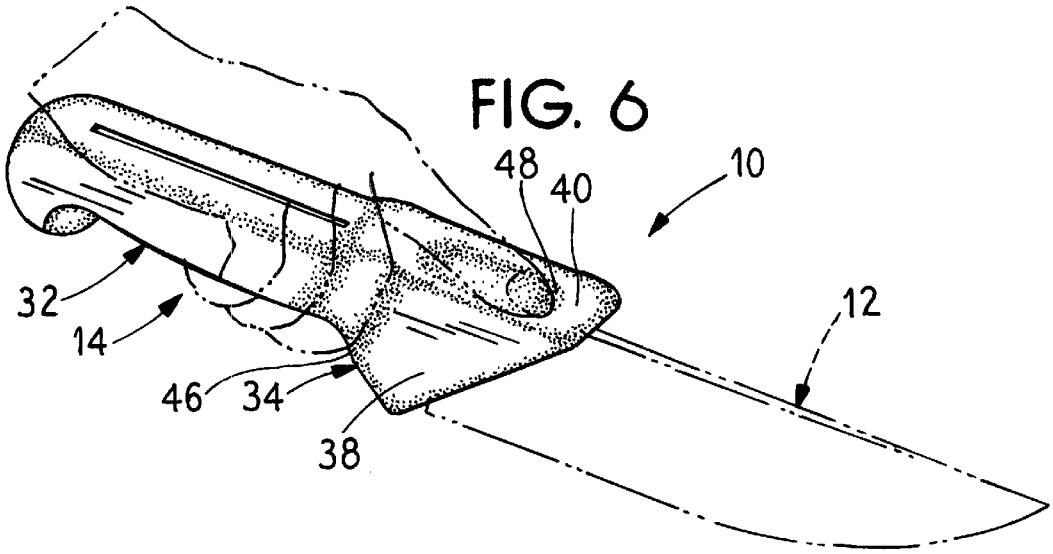
FIG. 6 is a right side perspective view similar to FIG. 1 depicting in phantom another of the hand grips for the handle of the present invention, the knife blade being shown therein in phantom.

FIG. 6 depicts a second grip of the handle 14 which is similar to the grip of FIGS. 4 and 5 except that the index finger is extended fully over the arm 40 such that a substantial portion of the index finger is positioned over the proximal portion of the blade face 20. The grip of FIG. 6 is particularly suited where the knife 10 is used for chopping vegetables or the like.

Figure 7:
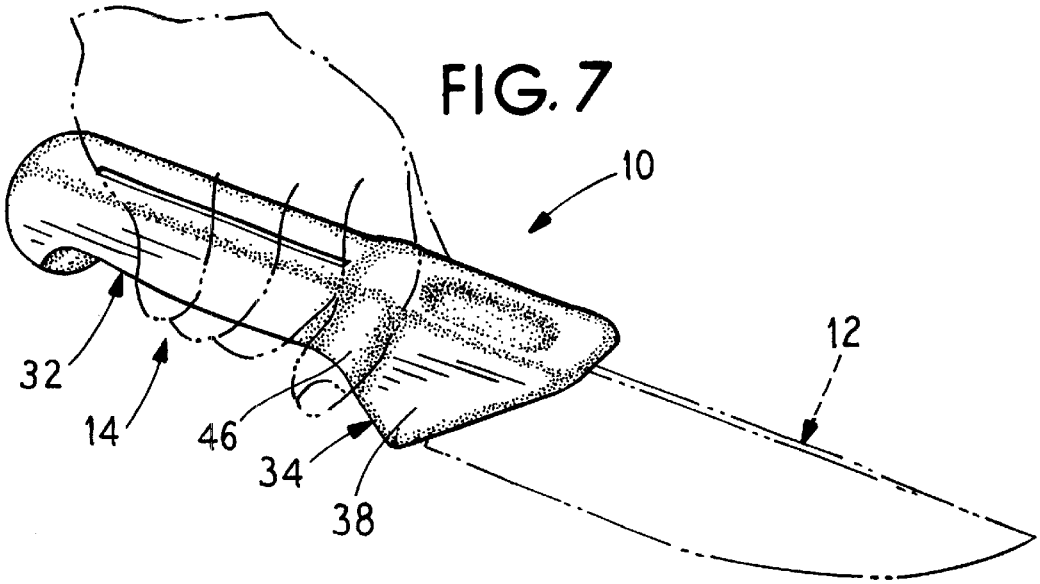
FIG. 7 is a right side perspective view similar to FIG. 1 depicting in phantom yet another of the hand grips for the handle of the present invention, the knife blade being shown therein in phantom.
Figure 8:
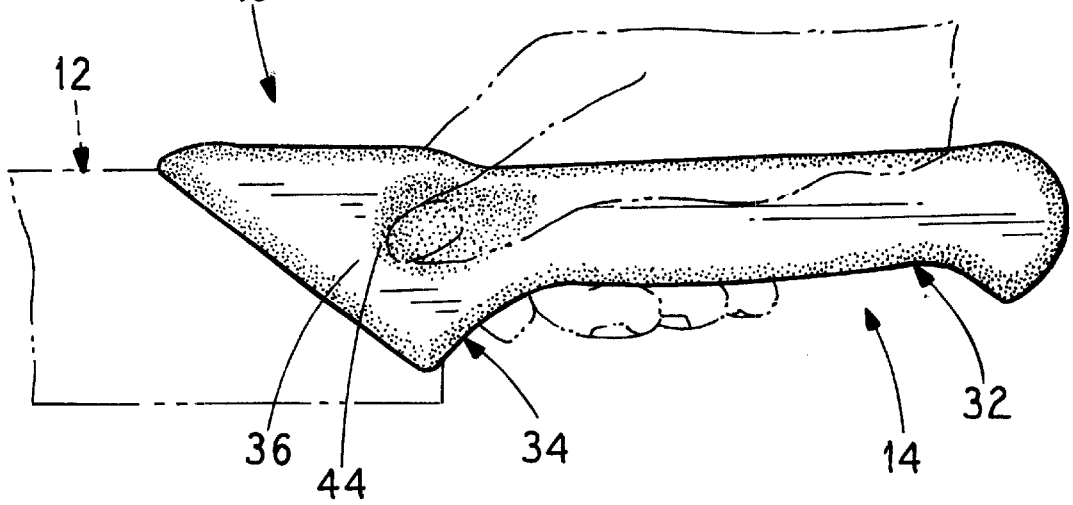
FIG. 8 is a left side elevational view of the grip shown in FIG. 7, the knife blade being shown therein broken away and in phantom.

FIGS. 7 and 8 depict a third grip of the handle 14 where the thumb of a user is extended and seated in the groove 44 in the side face 36 of the handle member 34 in a generally co-linear relationship relative to the longitudinal axis of the handle 14. The index finger is fully extended and seated in the groove 46 in the side face 38 in a generally perpendicular orientation relative to the longitudinal axis of the handle 14 where the side face of the extended index finger is in abutting relationship with the surface of the groove 46. The forefinger and the remaining fingers of the hand are wrapped around the body of the gripping member 32.

The grip of FIGS. 7 and 8 is particularly suited for the normal and natural repetitive production use of the knife 10 for slicing all types of food items such as, for example, vegetables, meats and sandwiches.

Figure 9:
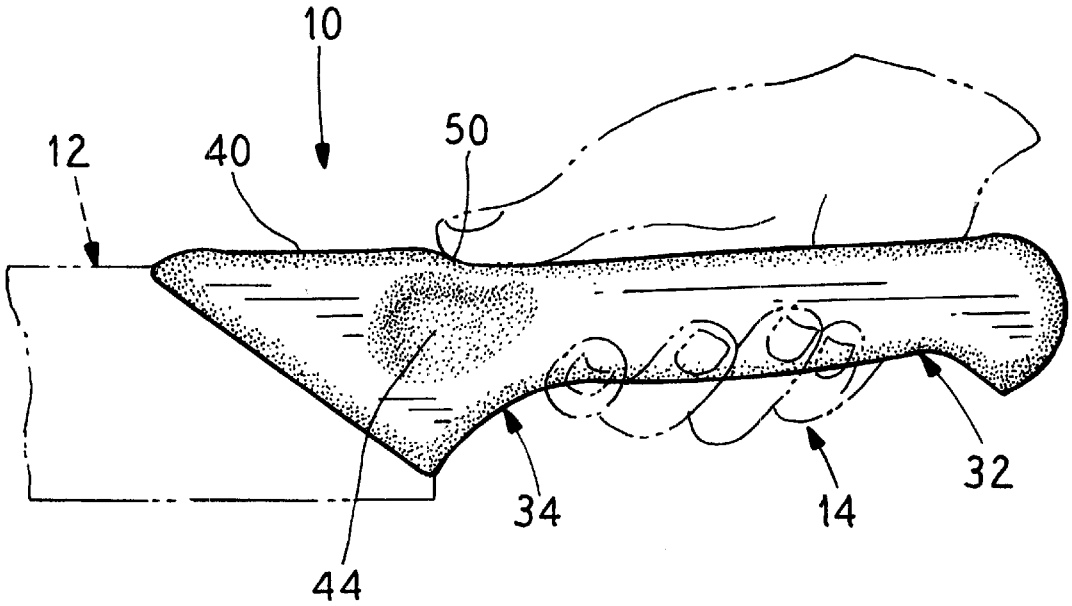
FIG. 9 is a left side elevational view of the knife of FIG. 1 depicting in phantom yet a further hand grip for the knife handle, the knife blade being shown therein broken away and in phantom.

FIG. 9 depicts a fourth grip of the handle 14 where the thumb of a user is seated against the shoulder 50 which bridges the digital member 34 and the gripping member 32. The thumb is positioned in a generally vertical co-planar orientation relative to the handle 14 and the remaining fingers are wrapped around the body of the gripping member 32. The grip of FIG. 9 is particularly suited where the knife 10 is used to cut through the bone of a meat item or the like. In these applications, the thumb against the shoulder 50 provides the leverage and pressure necessary to effect such a cut.

The foregoing specification and drawings are to be taken as illustrative but not limiting of the present invention. Still other handle configurations and embodiments utilizing the spirit and scope of the present invention are possible, and will readily present themselves to those skilled in the art.

For example, it is understood that the present invention encompasses not only the right hand embodiment of the knife handle 14 shown in FIGS. 1–9 but additionally the left hand embodiment of the knife handle 14 where the thumb groove is located in the side face 38 of the digital member 34 and the finger groove is located in the side face 36 of the digital member 34.

I claim:

1. A handle suitable for use in connection with a knife including a blade with proximal and distal side and top faces and a butt edge, the handle comprising an elongate hand gripping member and a unitary proximal digital member having side faces with respective top and bottom edges and overlying said proximal side faces of said blade and an arm overlying said proximal top face of said blade, said arm having a length greater than about one fourth the length of the handle and receiving the extended index finger of a user, said handle further including a thumb groove formed in one of the side faces of said proximal digital member, said thumb groove being disposed between and spaced from the top and bottom edges of said proximal digital member and including a forward edge disposed generally vertically co-linearly with the butt edge of the blade, the handle further including a first finger groove formed in the other of the side faces of said proximal digital member positioned generally perpendicularly to the longitudinal axis of the handle and including a forward edge and extending between and through the top and bottom edges of said proximal digital member, said handle still further including an index finger groove formed in said top of said arm of said proximal digital member and having a rear edge generally vertically co-linearly aligned with the forward edge of the thumb groove and the first finger groove respectively, the extended index finger of the user being received in said index finger groove.

2. The handle of claim 1 wherein said thumb groove extends generally along the longitudinal axis of said handle and said first finger groove extends generally perpendicular to the longitudinal axis of said handle.

* * * * *